US005820413A

United States Patent [19]

Yamada et al.

[11] Patent Number: 5,820,413

[45] Date of Patent: Oct. 13, 1998

[54] FUSE BOX

[75] Inventors: Satoshi Yamada; Hisaharu Kato, both of Shizuoka, Japan

[73] Assignee: Yazaki Corporation, Tokyo, Japan

[21] Appl. No.: 755,341

[22] Filed: Nov. 22, 1996

[30] Foreign Application Priority Data

Nov. 27, 1995 [JP] Japan ..... 7-307677

[51] Int. Cl.[6] ..... H01R 13/68

[52] U.S. Cl. ..... 439/621; 439/911

[58] Field of Search ..... 439/621, 698, 439/911, 830, 832, 833, 587, 589, 622, 349

[56] References Cited

U.S. PATENT DOCUMENTS

| | | | |
|---|---|---|---|
| 2,239,903 | 4/1941 | Schultz | 337/195 |
| 3,418,615 | 12/1968 | Canney | 337/190 |
| 3,976,967 | 8/1976 | Magherini | 337/211 |
| 4,268,106 | 5/1981 | Moerre | 439/621 |
| 4,543,557 | 9/1985 | Schaefer | 439/621 |
| 4,950,195 | 8/1990 | Perreault et al. | 439/621 |
| 5,253,143 | 10/1993 | Klinger et al. | 361/736 |
| 5,476,392 | 12/1995 | Inaba et al. | 439/376 |
| 5,564,716 | 10/1996 | Onoue et al. | 439/587 |
| 5,616,054 | 4/1997 | Quinlan | 439/621 |

FOREIGN PATENT DOCUMENTS

| | | | |
|---|---|---|---|
| 56-59783 | 5/1981 | Japan | H01R 13/74 |
| 63-9755 | 1/1988 | Japan | H01H 85/56 |
| 3-84572 | 8/1991 | Japan | H01R 23/68 |

*Primary Examiner*—Neil Abrams
*Assistant Examiner*—Yong Ki Kim
*Attorney, Agent, or Firm*—Sughrue, Mion, Zinn, Macpeak & Seas, PLLC

[57] ABSTRACT

A fuse is attached to an inner wall surface of a cover body that opens and closes in a hingelike manner while arranged over an opening of a housing. A pair of connected terminals is fixed to the housing at a predetermined interval in a longitudinal direction. Terminals of the fuse are electrically connected to the connected terminals when the cover body is closed, so that a circuit formed by the electric wires connected to the end portions of the respective connected terminals is caused to conduct. When the cover body is opened, the terminals are electrically disconnected from the connected terminals so that the circuit is opened.

21 Claims, 8 Drawing Sheets

FUSE BOX

BACKGROUND OF THE INVENTION

1. Field of the Invention

The invention relates to a fuse box used for closing and opening a high-voltage circuit or a large-current circuit of electric automobiles and the like.

2. Description of the Related Art

In a switchboard or the like of a high-voltage circuit, a male connector fixed to the cover of the switchboard is released from a corresponding female connector fixed to the main body of the switchboard to thereby open the high-voltage circuit when the cover is opened so that the operator can be prevented from erroneously receiving an electric shock by touching the electric poles.

There is proposed a connector device that serves also as a safety plug for breaking the circuit disclosed in U.S. Pat. No. 5,476,392.

As shown in FIG. 12, a connector device 50 includes: a female connector 52 fixed to a first base body (housing) 51; and a male connector 54 attached to a second base body 53. The second base body 53 serves as a cover with respect to the first base body 51 and is supported so as to be turnable about a turning shaft 52 arranged on one end of the first base body 51.

Ends 52*a*, 52*b* of the female connector 52 are partially exposed from the outer surface of the first base body 51, so that the ends 52*a*, 52*b* are connectable to high-voltage wires 55*a*, 55*b* from outside.

As shown in FIG. 13, the male connector 54 includes: a guide 57 that is attached to the second base body 53 by bolts 56, 56, and a connector main body 58 that is vertically and horizontally oscillatable with respect to the axial line of the turning shaft 52 while idly fitted into the guide 57.

The connector main body 58 of the male connector 54 includes: a rectangular prismatic base portion 61 made of an insulating resin material; a guide member 62 hanging from the base portion 61; and electrode pins 63, 63 hanging from the base portion 61 so as to extend in parallel with the guide member 62. The electrode pins 63, 63 are made of copper. Further, the electrode pins 63, 63 are molded by bending a square prismatic metal material so as to be U-shaped as viewed from the front.

When the second base body 53 is turned in a direction indicated by the arrow WC as shown in FIG. 12, the electrode pins 63 of the male connector 54 are introduced into a pair of insertion holes 52*d*, 52*e* formed in the female connector 52. As a result, the high-voltage wires 55*a*, 55*b* connected to the end portions 52*a*, 52*b* of the first base body 51 are caused to conduct.

On the other hand, in order to break the conduction, the second base body 53 is turned in a direction opposite to the arrow WC to take out the electrode pins 63 from the female connector 52.

Further, a connector device shown in FIG. 14 is also known. A female connector 64 has a terminal 66 embedded into a housing 65. The terminal 66 is substantially L-shaped in cross section. A high-voltage wire 67 is connected to a connecting portion 66*a* of the terminal 66 through a bolt 68. Elastically deformable contact surfaces 70*a*, 70*b* are formed so as to confront each other on a connector portion of the terminal 66 so that an electrode pin 69 of a male connector (not shown) can be fitted therebetween with ease. The circuit is closed when the electrode pin 69 is fitted between the contact surfaces 70*a*, 70*b* of the connector portion, and the circuit is opened when the electrode pin 69 is taken out of the contact surfaces 70*a*, 70*b* of the connector portion.

By the way, a conventional switchboards or the like of a high-voltage circuit generally has a circuit protecting fuse inside the circuit in addition to the aforementioned circuit breaking means. Independently of the connector device 50 serving also as a safety plug, e.g., a fuse box must be arranged in the circuit. Thus, not only the number of parts of the switchboard or the like is increased, but also the size of the connector device 50 is increased, which in turn prevents the cost of manufacture from decreasing.

SUMMARY OF THE INVENTION

Therefore, an object of the invention is to overcome the aforementioned problems and to provide a compact and inexpensive fuse box that has a circuit breaking means.

According to the present invention, there is provided a fuse box comprising: a housing having a connected terminal arranged in the housing; a cover body being arranged over an opening of the housing, an opening and closing hingelike; and a fuse arranged on an inner surface of the cover body portion; wherein an electrically connecting portion of the fuse is electrically connected to the connected terminal of the housing to thereby close a circuit when the cover body is closed, and is electrically disconnected from the connected terminal to thereby open the circuit when the cover body is opened.

DETAILED DESCRIPTION OF THE PREFERRED EMBODIMENTS

A fuse box, which is one mode of embodiment of the invention, will now be described in detail with reference to the accompanying drawings.

Figure 1:
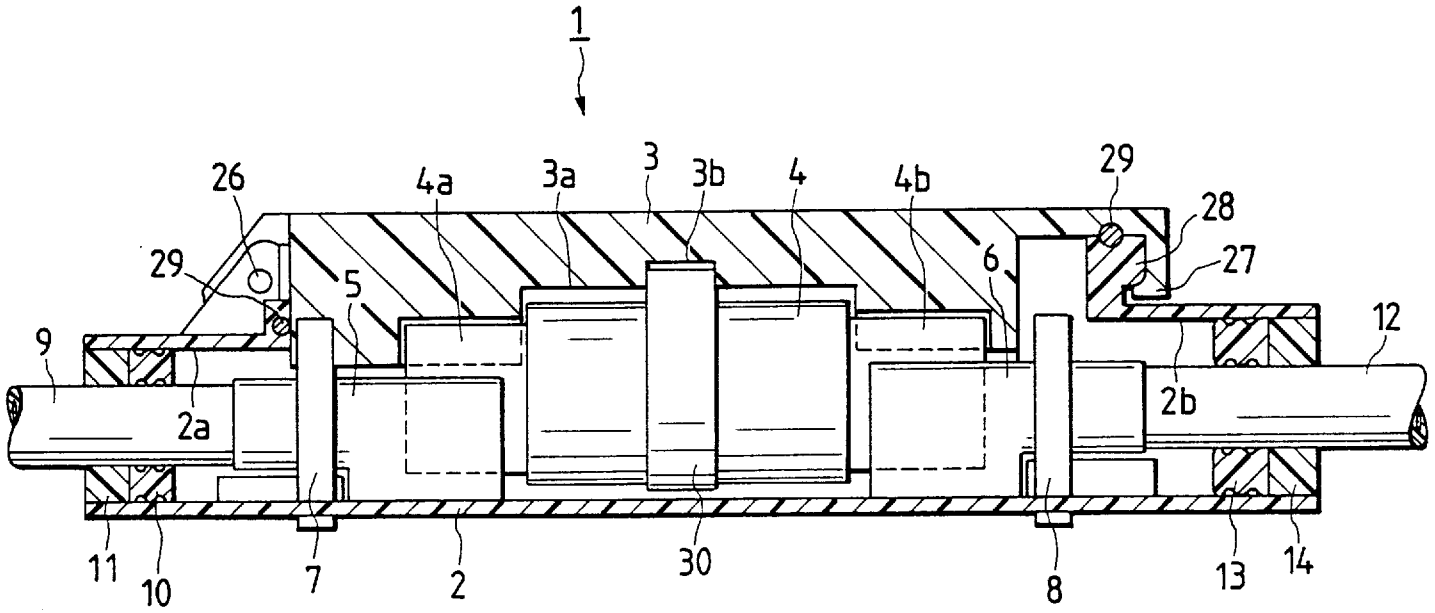
FIG. 1 is a longitudinal sectional view of a fuse box, which is a first embodiment of the invention.

As shown in FIG. 1, a fuse box 1, which is a first embodiment of the invention, has a housing 2, a cover body 3, and a fuse 4. Inside the housing 2 is a pair of connected terminals 5, 6. The connected terminals 5, 6 are arranged at a predetermined interval in a longitudinal director, and fixed by terminal stoppers 7, 8, respectively.

An electric wire 9 is electrically connected to one of the connected terminals, the terminal 5. The electric wire 9 is retained in an electric wire insertion hole 2*a* of the housing 2 through a seal member 10 and a rear holder 11. Further, an electric wire 12 is electrically connected to the other terminal 6, and retained in an electric wire insertion hole 2*b* of the housing 2 through a seal member 13 and a rear holder 14. It may be noted that only the connected terminal 5 will be described omitting the description of the connected terminal 6 because the connected terminals 5, 6 have the same structure.

Figure 2:
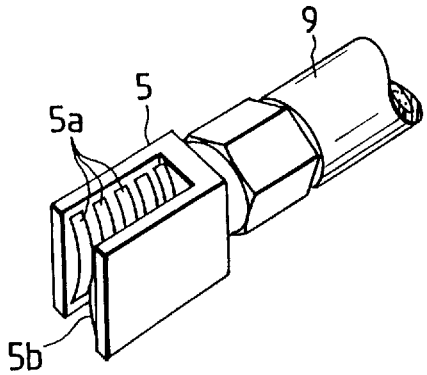
FIG. 2 is a perspective view showing a connected terminal own in FIG. 1.

As shown in FIG. 2, the connected terminal 5 is substantially square C-shaped, and has elastically deformable contact surfaces 5*a*, 5*b* formed on the confronting inner surfaces of the square C-shaped structure. The contact surfaces 5*a*, 5*b* are curved so as to have the middle portions thereof come closer toward each other. As a result of this structure, when a terminal 4*a* of the fuse 4, which will be described later, is inserted between the contact surface 5*a* and the contact surface 5*b*, the terminal 4*a* of the fuse 4 is elastically interposed between the contact surfaces 5*a*, 5*b* so as to reliably come in electrical contact with each other.

Figure 3:
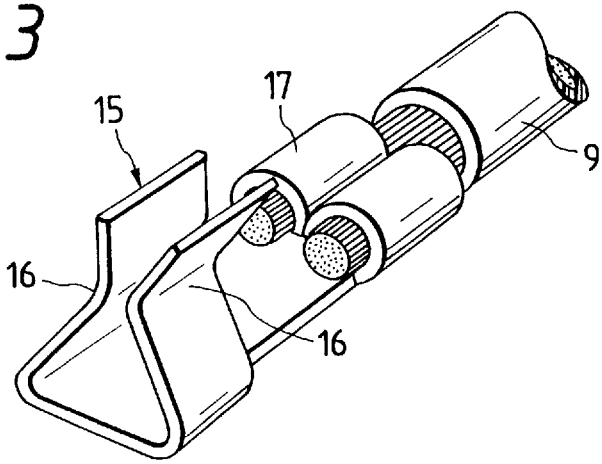
FIG. 3 is a perspective view showing a modified example of the connected terminal shown in FIG. 2.

Further, a connected terminal 15 shown in FIG. 3 can be used instead of the connected terminal 5. The connected terminal 15 has elastically deformable clamping portions 16, 16 formed by press-forming a sheet metal. The connected terminal 15 is coupled to the terminal portion of the electric wire 9 through a core crimping portion 17. The clamping portions 16, 16 are designed so that the upper ends thereof are expanded in order to facilitate insertion of the terminal 4*a* of the fuse 4, which will be described later. As a result, the clamping portions 16, 16 elastically clamp the terminal 4*a* to provide electric contact.

Figure 4:
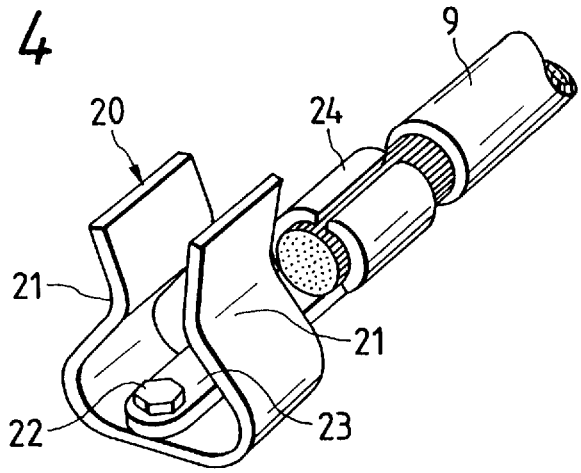
FIG. 4 is a perspective view showing a modified example of the connected terminal shown in FIG. 2.

Still further, a connected terminal 20 shown in FIG. 4 can be used instead of the connected terminal 15. The connected terminal 20 has elastically deformable clamping portions 21, 21 formed by press-forming a sheet metal. The terminal 4*a* of the fuse 4, which will be described later, is inserted into the clamping portions 21, 21, so that the connected terminal 20 and the terminal 4*a* of the fuse 4 are brought into electric contact with each other. An LA terminal 23 that has been crimped to the terminal portion of the electric wire 9 by a crimping portion 24 is coupled to the connected terminal 20.

The cover body 3 has a base portion thereof turnably supported by the housing 2 through a hinge pin 26. A turning end portion of the cover body 3 has a retaining claw 27. The retaining claw 27 is retained by a projection 28 of the housing 2. As a result of this construction, the housing 2 is closed by the cover body 3. Further, an O ring 29 is fitted into a portion along which the housing 2 comes in contact with the cover body 3, so that the housing 2 and the cover body 3 are sealed.

The aforementioned fuse 4 is arranged on the inner wall surface of the cover body 3. That is, a recess 3*a* is formed in the inner wall surface of the cover body 3, so that the fuse 4 can be accommodated in the recess 3*a*. In this case, a band insertion hole 3*b* is formed in the inner wall surface of the cover body 3, so that the fuse 4 is fixed by a band 30 that has been inserted into the band insertion hole 3*b*. It should be noted that a clamp or the like may be employed as means for fixing a fuse 4 instead of the band 30.

Figure 5:
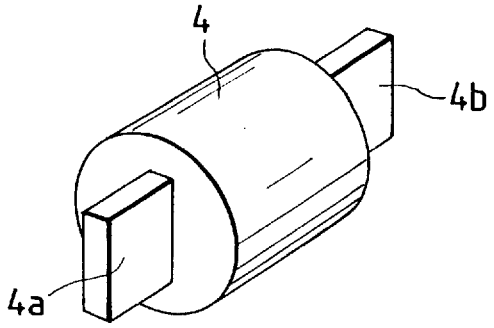
FIG. 5 is a perspective view of a fuse shown in FIG. 1.

As shown in FIG. 5, the fuse 4 has terminals 4*a*, 4*b* that are electrically connecting portions on both ends thereof. The terminals 4*a*, 4*b* of the fuse 4 are positioned so that the terminals 4*a*, 4*b* come out of contact with the connected terminals 5, 6 arranged in the housing 2 when the cover body 3 is opened and come in contact with the connected terminals 5, 6 when the cover body 3 is closed.

Figure 6:
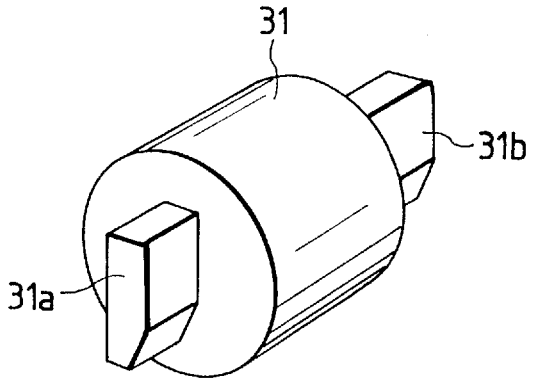
FIG. 6 is a perspective view showing a modified example of the fuse shown in FIG. 5.

It should be noted that the fuse 4 shown in FIG. 5 can be substituted for by a fuse 31 shown in FIG. 6. The fuse 31 is designed so that the lower end portions of terminals 31*a*, 31*b*, which are electrically connecting portions, are tapered. As a result of this construction, the terminals 31*a*, 31*b* can be inserted into the connected terminals 5, 6 with ease.

How the fuse box 1 of the invention is operated will be described with reference to FIGS. 7 and 8.

Figure 7:
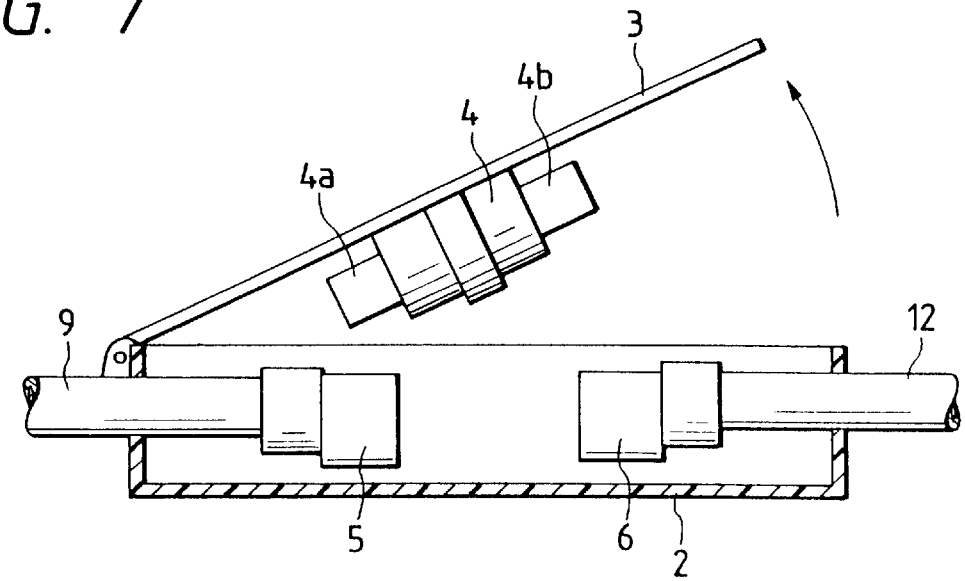
FIG. 7 is a diagram illustrative of how the fuse box shown in FIG. 1 is operated.

First, as shown in FIG. 7, the case where the cover body 3 is opened from the housing 2 will be described. When the cover body 3 is turned counterclockwise about the hinge pin 26 to thereby open the cover body 3 that has been closing the opening of the housing 2, the fuse 4 moves upward together with the cover body 3. As a result, the terminals 4*a*, 4*b* of the fuse 4 come out of contact with the connected terminals 5, 6 arranged in the housing 2, thereby breaking the circuit.

Figure 8:
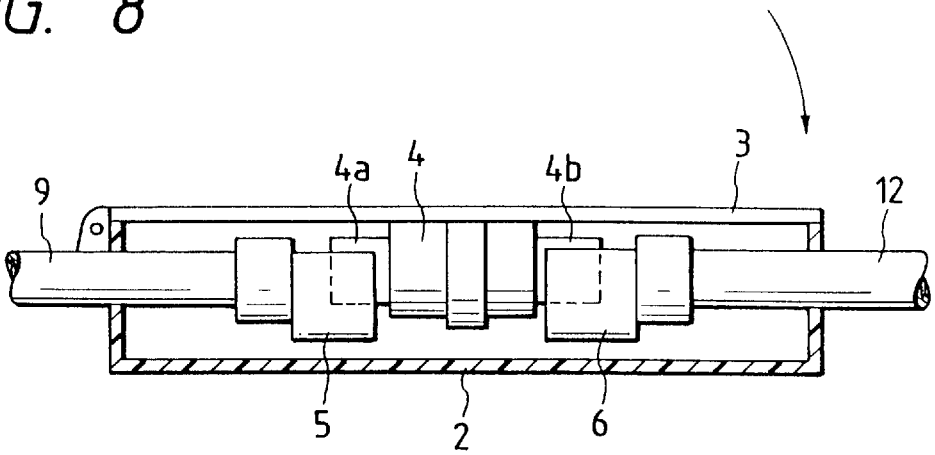
FIG. 8 is a diagram illustrative of how the fuse box shown in FIG. 1 is operated.

Then, as shown in FIG. 8, when the cover body 3 is turned clockwise about the hinge pin 26 to thereby close the opening of the housing 2, the fuse 4 moves downward together with the cover body 3. As a result, the terminals 4*a*, 4*b* of the fuse 4 come in contact with the connected terminals 5, 6 arranged in the housing 2, thereby causing the circuit to conduct.

That is, since the circuit is broken with the cover body 3 opened, the fuse 4 functions as a circuit breaker, and this prevents the operator from erroneously receiving an electric shock. In addition, since the circuit breaking means and the fuse are integrated with each other, the number of parts can be reduced even if the circuit breaking means is provided, which in turn contributes to providing a compact and inexpensive fuse box.

Further, since the terminals 4*a*, 4*b* of the fuse 4 are inserted into the connected terminals 5, 6 through the cover body 3 that opens and closes in a hingelike manner, the inserting force is reduced through leverage, thereby improving operability.

Still further, since the fuse 4 is disposed on the inner wall surface of the cover body 3 as an independent part, the fuse 4 can be taken out of the housing 2 by opening the cover body 3, which in turn contributes to facilitating replacement of fuses.

Figure 9:
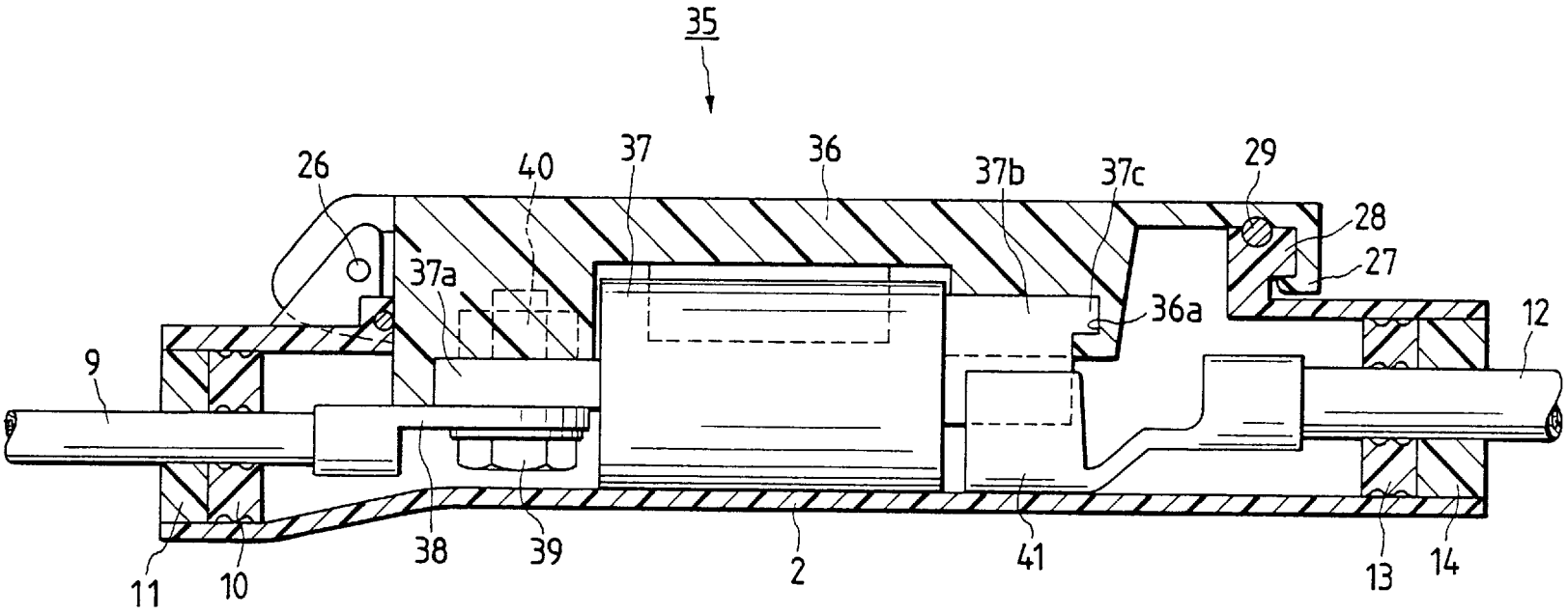
FIG. 9 is a longitudinal sectional view of a fuse box, which is a second embodiment of the invention.
Figure 10:
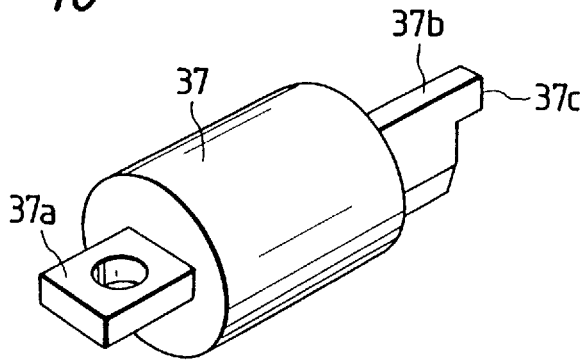
FIG. 10 is a perspective view of a fuse shown in FIG. 9.

FIGS. 9 and 10 are longitudinal sectional views of a fuse box 35, which is a second embodiment of the invention. It may be noted that the same or like parts and components as those of the fuse box 1, which is the first embodiment of the invention, are denoted as the same reference numerals in FIGS. 9 and 10 and that the descriptions thereof will be omitted.

The fuse box 35 has a housing 2, a cover body 36, and a fuse 37. A terminal 38 connected to the terminal portion of an electric wire 9 and a terminal 37*a* that is one electrically connecting portion of the fuse 37 are fixed to the cover body 36 by a bolt 39 so as to be in contact with each other.

The bolt 39 is screwed into a nut 30 arranged in the cover body 36. As shown in FIG. 10, a terminal 37*b*, which is the other electrically connecting portion of the fuse 37, has a projected portion 37*c* formed on the front end thereof. The projected portion 37*c* is fitted into a recess 36*a* of the cover body 36 (see FIG. 9). That is, the fuse 37 is fixed to the cover body 36 not only by the terminal 37*a* being mounted on the cover body 36 with the bolt 39 but also by the projected portion 37*c* of the terminal 37*b* being fitted into the recess 36*a* of the cover body 36.

The terminal 37*b*, which is the electrically connecting portion of the fuse 37 located on the turning end side of the cover body 36, is inserted into a clamping portion of the connected terminal 41 fixed to the housing 2. Since the lower end portion of the terminal 37*b* is tapered, the terminal 37*b* can be inserted into the clamping portion of the connected terminal 41 easily.

Figure 11:
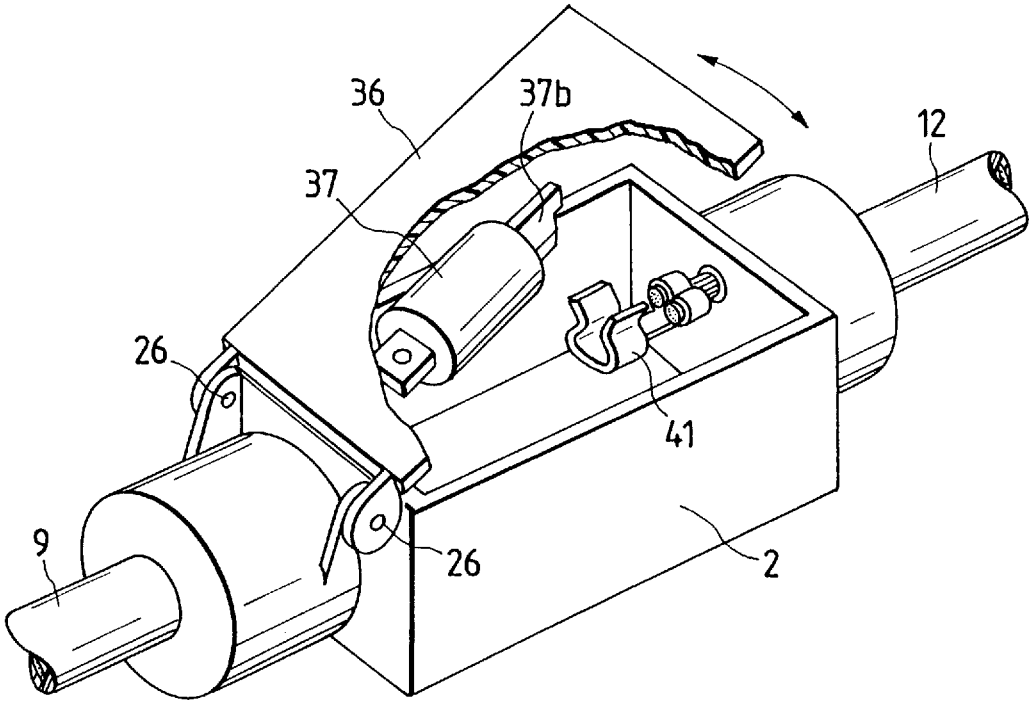
FIG. 11 is a perspective view illustrative of how the fuse box shown in FIG. 9 is operated.
Figure 12:
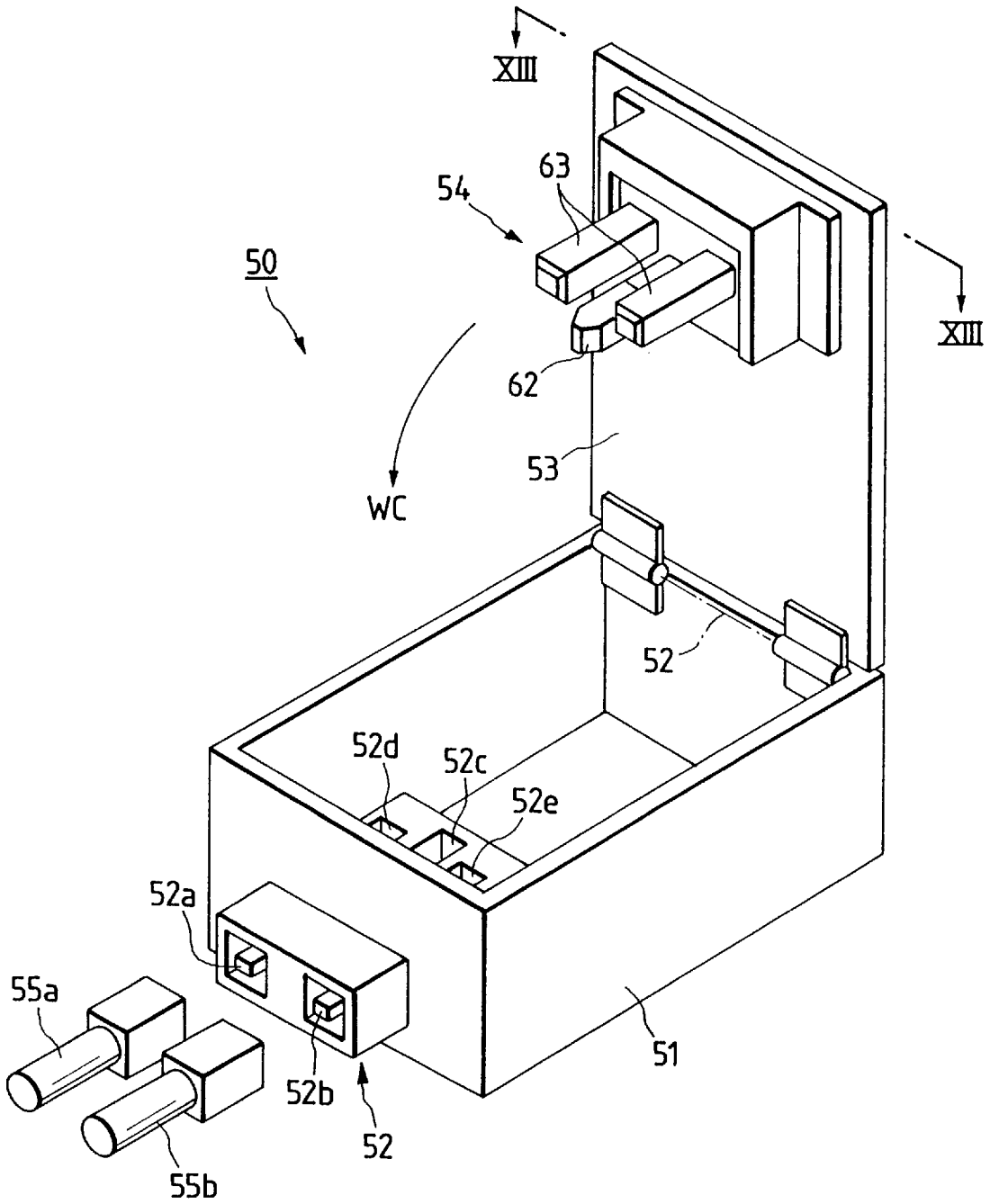
FIG. 12 PRIOR ART
FIG. 12 is a perspective view of a conventional connector device functioning also as a safety plug.
Figure 13:
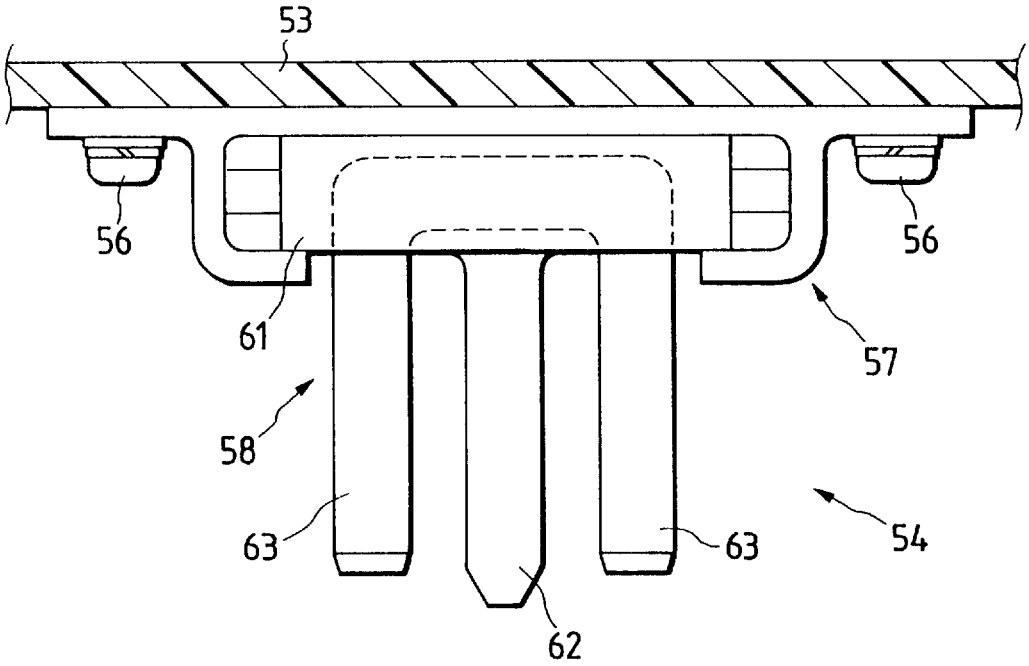
FIG. 13 PRIOR ART
FIG. 13 is a view taken along a line XIII—XIII of FIG. 12.
Figure 14:
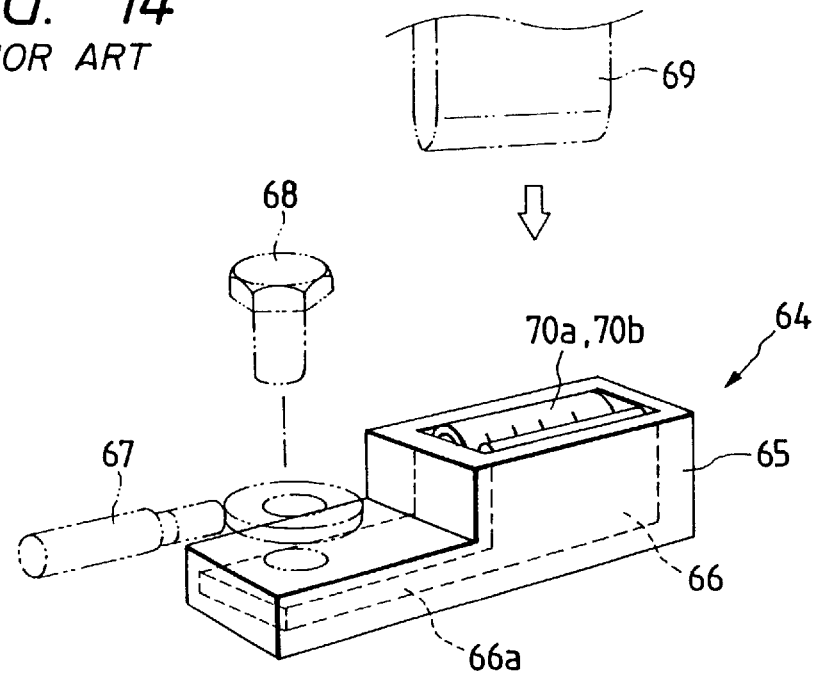
FIG. 14 PRIOR ART
FIG. 14 is a perspective view of a conventional connector device.

Then, how the thus constructed fuse box 35 of the invention is operated will be described with reference to FIG. 11.

First, the case where the cover body 36 is opened from the housing 2 will be described. When the cover body 36 is turned counterclockwise about the hinge pin 26 to thereby open the cover body 36 that has been closing the opening of the housing 2, the fuse 37 moves upward together with the cover body 36. As a result, the terminal 37*b* of the fuse 37 comes out of contact with the connected terminal 41 arranged in the housing 2, thereby breaking the circuit.

Then, when the cover body 36 is turned clockwise about the hinge pin 26 to thereby close the opening of the housing 2, the fuse 37 moves downward together with the cover body 36. As a result, the terminal 37*b* of the fuse 37 comes in contact with the connected terminal 41, thereby causing the circuit to conduct.

In the fuse box 35 that is the second embodiment of the invention, the terminal 37*b* of the fuse 37 located on the turning end side of the cover body 36 is fixed onto the inner wall surface of the cover body 36 so that the circuit is closed by the terminal 37*b* being electrically connected to the connected terminal 41 arranged in the housing 2 when the cover body 36 is closed. Therefore, the electric wire 9 connected to the terminal 37*a* of the fuse 37 located on the turning center side of the cover body 36 is not bent much, which therefore will not hinder the opening and closing operation of the cover body 36.

Further, the fuse box of the invention is not limited to the constructions of the aforementioned modes of embodiment. It goes without saying that the construction of the housing, cover body, fuse, connected terminals, and the like can be modified in various ways.

As described in the foregoing, the fuse box of the invention is characterized in that a fuse is arranged on an inner wall surface of a cover body that opens and closes in a hingelike manner; the circuit is broken by opening the cover body; and the circuit is caused to conduct by closing the cover body. That is, since the circuit is broken with the cover body opened, the fuse serves as a circuit breaking means, thereby preventing the operator from erroneously receiving an electric shock. In addition, since the circuit breaking means and the fuse are integrated with each other, the fuse box of the invention can reduce the number of parts while providing the circuit breaking means, which in turn contributes to reducing the cost of manufacture. Hence, a compact and inexpensive fuse box can be provided.

Moreover, the invention is characterized in that the fuse is attached to the inner wall surface of the cover body. Therefore, the fuse can be taken out of the housing by opening the cover body, thereby allowing the fuse to be taken out of the cover body with ease. Therefore, fuses can be replaced with ease.

What is claimed is:

1. A fuse box comprising:

a housing having a first side and a second side opposite to said first side, wherein said sides define an opening;

a first connected terminal and a second connected terminal arranged in said opening of said housing;

a first electric wire insertion hole in said housing first side and a second electric wire insertion hole in said housing second side, wherein said first and second connected terminals respectively extend coaxially with said first and second electric wire insertion holes;

a cover body having an inner surface being arranged over said opening of said housing, and connected to said housing for opening and closing in a hingelike manner; and a fuse, having a first electrically connecting portion, arranged on said inner surface of said cover body;

wherein said first electrically connecting portion of said fuse is electrically connected to said first connected terminal of said housing to thereby close a circuit when said cover body is closed, and is electrically disconnected from said first connected terminal to thereby open the circuit when said cover body is opened.

2. The fuse box according to claim 1, wherein said fuse includes a second electrically connecting portion, opposite to said fuse first electrically connecting portion, that is electrically connected to said second connected terminal arranged in said housing to thereby close a circuit when said cover body is closed, and is also electrically connected to said second connected terminal when said cover body is opened.

3. The fuse box according to claim 1, wherein said first electric wire insertion hole retains an electric wire.

4. The fuse box according to claim 3, further comprising a seal member disposed in said first electric wire insertion hole for retaining the electric wire.

5. The fuse box according to claim 1, wherein one of said connected terminals is substantially square C-shaped, wherein said C-shape is formed by a pair of parallel arms having confronting inner surfaces that are mutually perpendicular to an end segment such that said parallel arms extend away from a wire connection portion of said connected terminal.

6. The fuse box according to claim 1, wherein said first connected terminal has elastically deformable clamping portions press-formed from sheet metal ahd wherein upper ends of said clamping portions are expanded in order to facilitate insertion of said first electrically connecting portion of said fuse.

7. The fuse box according to claim 1, wherein said housing further comprises a turning end and a retaining end opposite to said turning end, said cover body further comprises a hinge end connected to said turning end of said housing and a free end opposite to said hinge end, wherein a retaining claw is provided on said free end of said cover body and a projection is provided on said retaining end of said housing for retaining said retaining claw.

8. The fuse box according to claim 1, wherein an O ring is fitted to a portion of said housing which is contacted by said cover body when said cover body is in its closed position.

9. The fuse box according to claim 1, wherein a recess in which said fuse is accommodated is formed on said inner surface of said cover body.

10. The fuse box according to claim 1, wherein an end portion of said electrically connecting portion of said fuse is tapered.

11. The fuse box according to claim 1, wherein said first and second electric wire insertion holes are coaxial with each other.

12. The fuse box according to claim 1, wherein said cover body further comprises a top surface that is substantially planar, and the longitudinal axis of said fuse is parallel to said top surface.

13. The fuse box according to claim 1, further comprising terminal stoppers connected between said connected terminals and said housing.

14. The fuse box according to claim 1, wherein the longitudinal axis of said fuse is located in a plane that is offset from a plane that contains the longitudinal axes of said first and second electric wire insertion holes.

15. The fuse box according to claim 1, wherein said fuse further includes a second electrically connecting portion, opposite to said fuse first electrically connecting portion, that is electrically connected to said second connected terminal to thereby close a circuit when said cover body is closed, and is electrically disconnected from said second connected terminal to thereby open the circuit when said cover body is opened.

16. The fuse box according to claim 4, further comprising a rear holder located in said first electric wire insertion hole and abutted with said seal member.

17. The fuse box according to claim 5, further comprising elastically deformable contact surfaces formed on said confronting inner surfaces.

18. The fuse box according to claim 17, wherein said confronting inner surfaces are planar and said elastically deformable contact surfaces extend from the plane of each of said confronting inner surfaces.

19. The fuse box according to claim 9, wherein said fuse contains a band intermediate its ends and said cover body recess further includes a band insertion hole such that said fuse band is retained within said band insertion hole.

20. The fuse box according to claim 10, wherein said end portion of said electrically connecting portion of said fuse further comprises a pair of walls extending therefrom, wherein said walls are parallel to one another over a portion thereof, and one of said walls converges towards the other of said walls over another portion thereof.

21. The fuse box according to claim 20, wherein said portion of said one wall that converges towards the other wall is planar.

* * * * *